US005413806A

United States Patent [19]

Braun

[11] Patent Number: 5,413,806

[45] Date of Patent: May 9, 1995

[54] STRIP COATING MACHINE WITH THICKNESS CONTROL

[75] Inventor: Curt Braun, Riverside, Calif.

[73] Assignee: Hunter Engineering Company, Inc., Riverside, Calif.

[21] Appl. No.: 11,986

[22] Filed: Feb. 1, 1993

[51] Int. Cl.[6] ..... B05D 1/28; B05C 1/12; B05C 11/00; B05C 13/00

[52] U.S. Cl. ..... 427/9; 427/428; 427/211; 118/665; 118/670; 118/672; 118/712; 118/224; 118/225; 118/246; 118/262; 118/34; 118/44

[58] Field of Search ..... 118/665, 670, 712, 65, 118/223, 224, 227, 235, 246, 672, 674, 44, 34, 68, 225, 249, 262, 258; 427/9, 428, 211

[56] References Cited

U.S. PATENT DOCUMENTS

| | | | |
|---|---|---|---|
| 3,510,374 | 5/1970 | Walker | 118/712 |
| 3,521,600 | 7/1970 | Toya | 118/665 |
| 3,843,434 | 10/1974 | Heiks et al. | 118/665 |
| 3,844,813 | 10/1974 | Leonard et al. | 118/246 |
| 3,854,441 | 12/1974 | Park | 118/34 |
| 3,862,553 | 1/1975 | Schwemmer et al. | 118/665 |
| 3,989,937 | 11/1976 | Fay et al. | 118/712 |
| 4,242,807 | 1/1981 | Braun | 118/68 |
| 4;309,960 | 1/1982 | Waldvogel | 118/665 |
| 4,704,296 | 11/1987 | Leanna et al. | 118/665 |
| 5,310,573 | 5/1994 | Tanokuchi et al. | 427/9 |

OTHER PUBLICATIONS

"Controlling Glue Coating Thickness", Measurement and Control, vol. 6 (Feb., 1973), No. 2, p. 52.

*Primary Examiner*—W. Gary Jones
*Assistant Examiner*—Steven P. Griffin
*Attorney, Agent, or Firm*—Christie, Parker & Hale

[57] ABSTRACT

A continuous strip coating machine has top and bottom applicator rolls and a backup roll adjacent the top applicator roll. A lift roll to lift the strip of material and thus vary the angle of wrap of the strip about the bottom applicator roll is provided. The use of the lift roll in turn varies the pressure between the strip and the roll and thus the thickness of the coating applied to the strip bottom. Thickness may be measured indirectly by measuring pressure of the strip on the applicator roll. Thickness may also be measured directly. Oscillations of the strip in a drying oven may also be sensed and compensated for. Feedback control is used with the thickness measuring techniques to control the coating thickness by varying angle of wrap, relative speed between the applicator roll and strip, and/or nip pressure between the applicator roll and a transfer roll that transfers coating material to the applicator roll.

23 Claims, 3 Drawing Sheets

STRIP COATING MACHINE WITH THICKNESS CONTROL

BACKGROUND OF THE INVENTION

The invention pertains to a machine for coating continuous strip materials such as sheet steel or aluminum. More particularly it pertains to the control of the thickness of a coating which is applied to the bottom face of the strip.

A well developed field exists in the art of machines for continuous coating of strip materials. A common application of this is in the area of applying paint or primer to a strip of sheet metal which is initially in the form of large coils. In a typical industrial setting, the material is uncoiled and delivered to a machine which applies the coating to both faces of the strip. After exiting the coating machine the strip progresses through a drying oven. As the wet strip cannot be handled while it progresses through the oven, the strip has the form of a catenary suspended by the coating machine at the entrance to the oven and by a coiler, take-up bridle, or other receiving device at the exit. In certain ovens a part of the weight of the strip may be supported by gas flotation.

To insure a smooth flow of the strip, the end of each coil must be attached (welded) to the beginning of the next. To allow the attachment without altering the progress of the strip through the coating machine and oven, an accumulator is provided upstream of the coating machine. This permits the line to be stopped upstream of the accumulator to attach the end of one coil to the beginning of the next, while downstream of the accumulator, movement of the strip is not interrupted. Downstream of the oven the strip may be recoiled by a coiling unit and the coils can be cut from the strip by a cutting unit. Another accumulator permits continuous movement through the oven with intermittent stops to shear the strip adjacent to the coiler.

A typical coating machine applies a coating to the top face of the strip prior to applying a coating to the bottom face. A strip enters the machine and is held between a backup roll and a top applicator roll which applies the coating to the top face of the strip. A transfer roll adjacent to the top applicator roll is partially immersed in a coating material reservoir. The thickness of the coating applied to the top face of the strip can be varied by varying the pressure between the applicator and backup rolls. Similarly the amount of coating delivered to the applicator roll can be controlled by varying the pressure between the transfer and applicator rolls. Relative speeds of the rolls and strip can also be used for control.

The strip is then routed to the bottom applicator roll which applies a coating to the bottom face of the strip. After leaving the bottom applicator roll, the strip enters the drying oven.

As the seam created by the attachment of sequential coils of strip material passes through the coating machine, it has the potential to damage the applicator rolls. To avoid this damage the top applicator roll may be disengaged from the strip by the same means that control the pressure between the two.

Since the wet strip exiting the machine is supported by the bottom applicator roll, this roll cannot be so easily disengaged. To protect the bottom applicator roll, a lift roll is included between the backup and bottom positioned below the strip and is not in contact with it. As the seam passes through the machine, the lift roll is rapidly raised and brought into contact with the bottom face of the strip. The lift roll lifts the strip out of contact with the bottom applicator roll so that the catenary is temporarily suspended from the lift roll. As soon as the seam has passed, the lift roll is lowered and the strip again is supported by the bottom applicator roll.

Since the coating on the top face of the strip is wet, no corresponding backup roll can be provided for the bottom applicator roll. Thus, the force between the bottom applicator roll and the strip is provided by tension in the strip as a function of the angle of wrap of the strip around the bottom applicator roll.

There is a tension T in the strip and the strip wraps around the roll through an angle $\Theta$ (defined by the arc of contact between strip and roll). If viewed with respect to a reference point midway along that arc, a section of strip coming from the backup roll and a section of strip leading to the drying oven each exert a force of a magnitude T on the bottom applicator roll. It can be seen that the circumferential components of the forces cancel each other, but the radial (normal) components do not. The radial components are each given by the expression $T\sin(\Theta/2)$, for a total normal force $N=2T\sin(\Theta/2)$.

If the oven has a fixed geometry, then to maintain a correspondingly fixed geometry of the catenary form of the strip, the tension in the strip and the orientation at which the strip leaves the roll must be fixed. Accordingly if the path of the strip between the backup and bottom applicator roll is also fixed, the force between the strip and the bottom applicator roll, and thus the thickness of the coating on the bottom face are fixed by the catenary geometry. It should be noted that the forces which are referred to are clearly not discrete forces operating at discrete locations, but rather net forces due to a pressure distribution along the arc of contact between the strip and the roll. Where the oven has a gas flotation system, the shape of the catenary is determined by the depth the catenary reaches due to weight of the strip as counteracted by gas flotation. The tension on the strip at the coater may be varied if the flotation pressure is varied to compensate for the tension applied by the take-up bridle (decreasing flotation to correspond with increasing tension and vice versa).

One problem that is encountered in obtaining uniform film thickness of a coating is oscillation of the strip in the drying oven. Such uncontrolled oscillations may occur in a strip supported entirely between the bottom applicator roll and a take-up bridle at the end of the oven, or may occur in a strip partly supported by flotation. When an oscillation occurs, there may be variations in the contact between the strip and the bottom applicator roll. These variations may be seen as slight streaks in the coating. It would be highly desirable to avoid such streaks.

The thickness of the coating applied to the bottom face of a strip is thus not readily controllable. For a given coating material the thickness is predetermined based on many factors including the geometry of the coating machine, viscosity of the coating material, temperature, relative speeds of various rolls, roll eccentricity, nip pressures between the coater rolls, surfaces on the rolls and the shape and weight of the catenary.

It is therefore desirable to produce a strip coating machine which features a mechanism to control the thickness of the coating that is applied to the bottom face of a strip as well as to the top face.

SUMMARY OF THE INVENTION

The present invention provides an apparatus and method for controlling the thickness of a coating applied to the bottom face of a strip of material in a continuous strip coating machine. Control is achieved by (a) use of a lift roll to lift the strip of material and thus vary the angle of wrap of the strip about the bottom applicator roll, (b) changing the relative speed between a bottom applicator roll and a moving strip, and (c) varying nip pressure between a transfer roll and the bottom applicator roll. This in turn varies the pressure between the strip and the roll and thus the coating thickness.

The thickness of the coating is measured either directly or indirectly such as by way of measuring the force which is applied to the bottom applicator roll and converting the force to a coating thickness based upon known geometry and coating properties. If the coating is thinner than desired, the lift roll is raised further, reducing the pressure between the strip and bottom applicator roll and permitting a thicker coating. If the coating is too thick, the lift roll can be incrementally lowered until it is no longer in contact with the strip and thus the force on the applicator roll is at a maximum and the coating thickness is at a minimum.

Alternatively, coating thickness can be measured directly for controlling machine operating parameters. In addition oscillations of the strip in a drying oven may be sensed and that information used for changing the wrap angle of the strip around the bottom applicator roll. These input and output parameters may be used separately or in any combination.

DESCRIPTION OF THE DRAWINGS

The above-mentioned and other features of this invention are more fully set forth in the following detailed description of the presently preferred and other embodiments of this invention and by reference to the accompanying drawings wherein.

DESCRIPTION OF THE ILLUSTRATED EMBODIMENTS

Figure 1:
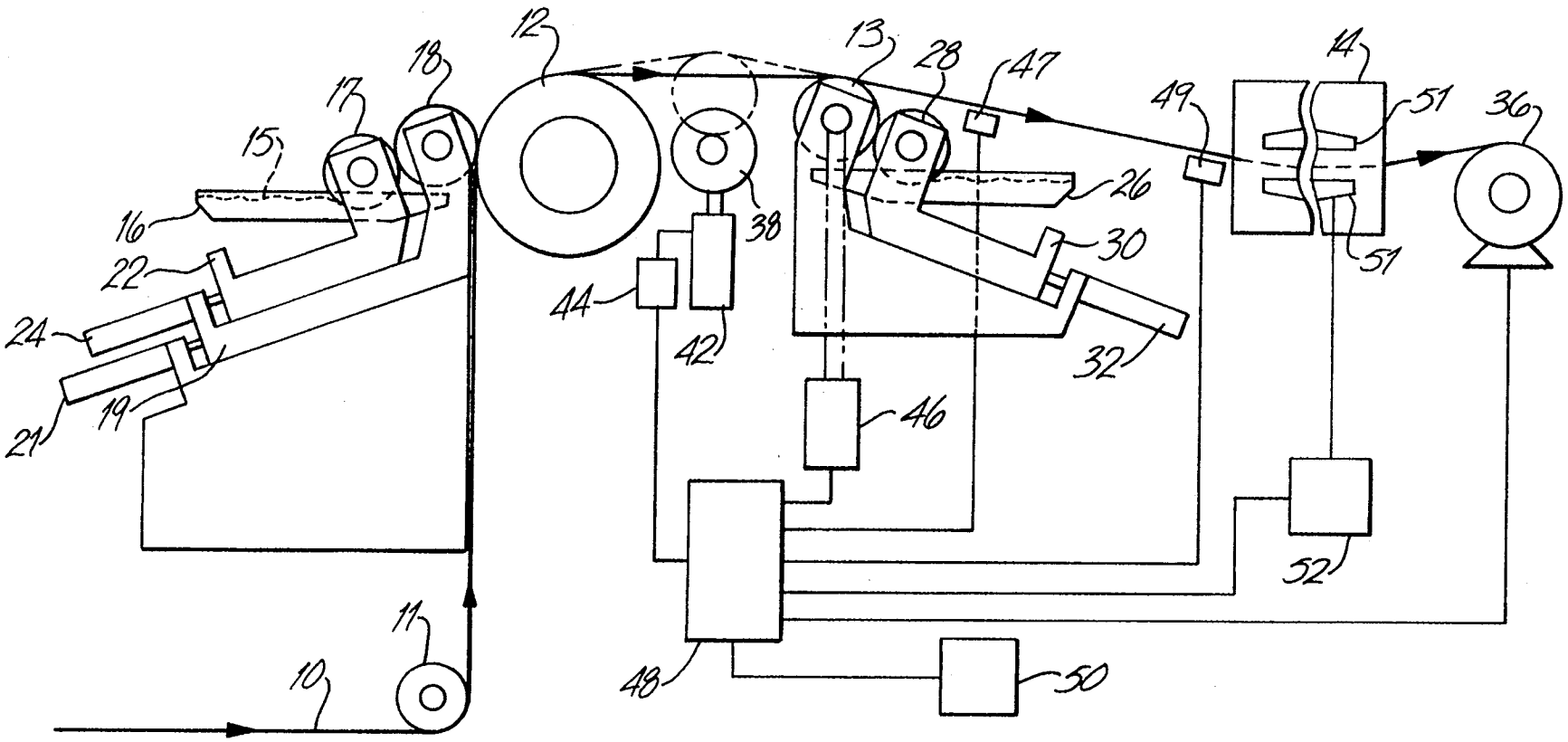
FIG. 1 is a partial side schematic view of a continuous strip coating machine with a fully engaged lift roll position shown in phantom.

The continuous strip coating machine shown in the drawings is illustrated only schematically without illustrating much of the supporting structure. All that is illustrated is the part required for an understanding of this invention. A strip 10 of material to be coated enters the coating machine horizontally and is turned to a vertical direction by a guide roll 11. The strip then wraps part way around a large diameter backup roll 12 from which it leaves approximately horizontally. The strip then passes over a bottom applicator roll 13 and descends in a long catenary through a drying oven 14.

Instead of leaving the backup roll horizontally, the strip may travel upwardly at a substantial angle before passing over a bottom applicator roll elevated above the backup roll. Such an arrangement provides increased pressure between the strip and bottom applicator roll.

A coating is applied to the top face of the strip by a top coater station adjacent to the backup roll. The coating material 15 to be applied to the top face of the strip is contained in a top coating reservoir 16. A top transfer roll 17 is partially immersed in the coating material in the reservoir and picks up coating material as the transfer roll rotates. Some of this coating material is transferred to a top applicator roll 18 which bears against the top face of the strip as it wraps around the backup roll.

The top applicator roll is mounted on a top applicator roll carriage 19 which can be moved towards or away from the backup roll by a hydraulic actuator 21. The thickness of the coating applied to the top face of the strip is controlled by the pressure applied by the top applicator roll to the strip where it is backed up by the backup roll on the opposite side of the strip. The hydraulic actuator controls the applied pressure. The transfer roll is mounted on a top transfer roll carriage 22 which is also mounted on the top applicator roll carriage. Nip pressure between the transfer roll and applicator roll is controlled by a hydraulic actuator 24 for controlling the amount of coating material transferred from the transfer roll to the applicator roll.

The strip proceeds from the top coater station to a bottom coater station for coating to be applied to the bottom face of the strip. The coating material is contained in a bottom coating reservoir 26. A bottom transfer roll 28 is positioned adjacent the bottom applicator roll and is partially immersed in the coating material in the reservoir. The bottom transfer roll is mounted on a bottom transfer roll carriage 30 which is moveable via a hydraulic actuator 32. The coating is delivered from the bottom coating reservoir to the bottom applicator roll via the bottom transfer roll. The amount of coating delivered to the bottom applicator roll can be controlled by adjusting the nip pressure between the bottom applicator roll and transfer roll using the hydraulic actuator. The bottom applicator roll delivers the coating to the bottom face of the strip.

From the bottom applicator roll, the strip proceeds to the drying oven in which the strip has a catenary form, suspended at one end of the catenary by the bottom applicator roll and at the other by a coiler 36. In practice, a take-up bridle for controlling strip speed, an accumulator and a cutter may be positioned between the oven and the coiler. The exact machinery used at the exit end of the oven is not material to this invention.

As illustrated, coating material is transferred directly from a transfer roll to an applicator roll. In many embodiments three rolls are used, a pickup roll, a metering roll and an applicator roll. The coating material is taken from the reservoir by the pickup roll and a film of coating material is transferred to the metering roll. This film is in turn transferred to the applicator roll. The thickness of the film applied to the strip is a function of the relative speeds of the two or three rolls and the nip pressure between them. The rolls may rotate in either the forward or reverse direction. For simplicity, a two roll applicator station is used in this description, with the one or two rolls that apply coating material to the applicator roll being simply referred to as a transfer roll.

A lift roll 38 is located between the backup roll and bottom applicator roll. An actuator is provided for raising and lowering the lift roll. The actuator may comprise a hydraulic linear position transducer 42 controlled by a servo-valve 44 (shown in FIG. 1), a stepper motor 40 (shown in FIG. 2), or other equivalent means. Hydraulic actuators are preferred since they operate very rapidly and can compensate for transient variations in pressure more quickly than presently available stepper motors.

In prior art operation, the lift roll has occupied either a disengaged position shown in solid lines in FIG. 1 or a fully engaged position shown in phantom. In the fully engaged position, the lift roll lifts the strip out of contact with the bottom applicator roll so as to allow passage of a seam in the strip.

Figure 2:
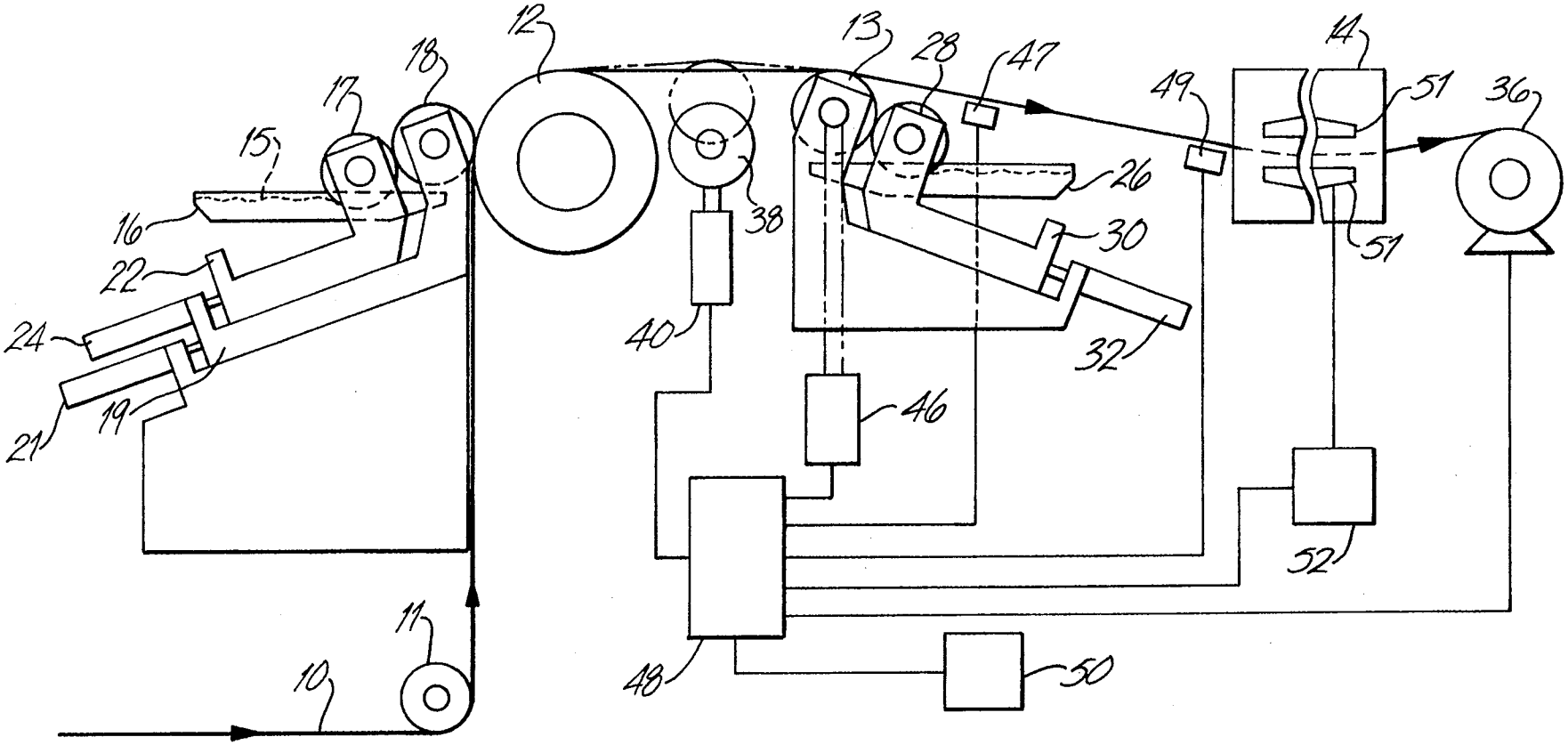
FIG. 2 is a partial side schematic view of a continuous strip coating machine with a lift roll in a partially engaged position in accordance with principles of the present invention shown in phantom.

According to the present invention, the lift roll is moved to a partially engaged position to control the angle of wrap of the strip around the bottom applicator roll and thus modulate the force between the roll and the strip, as shown in FIG. 2. Such a position is characterized by both the lift roll and bottom applicator roll contacting the strip. The thickness of the coating applied to the bottom face of the strip can be controlled by adjusting the pressure between the strip and bottom applicator roll by moving the lift roll, hence controlling the angle of wrap of the strip around the bottom applicator roll.

Figure 3:
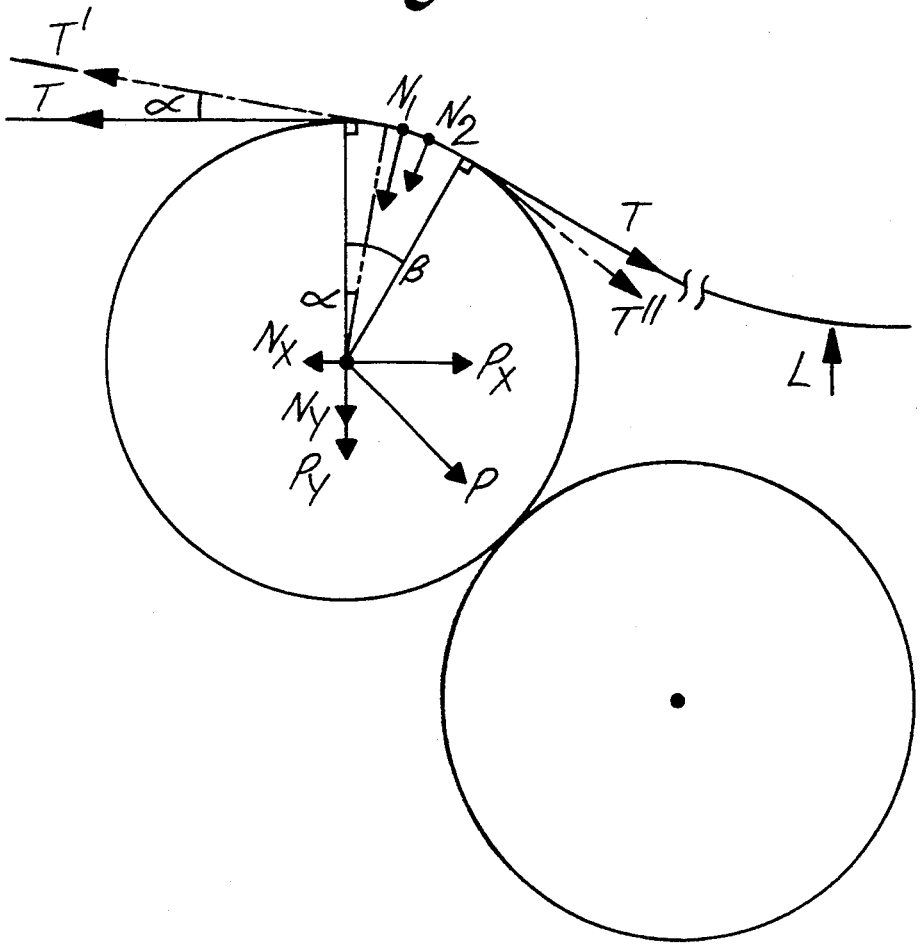
FIG. 3 is a side schematic view of a continuous strip and a bottom applicator roll showing the forces acting thereon, with a strip in a partially engaged lift roll position shown in phantom.

FIG. 3 shows the forces on the bottom applicator roll and strip, with a strip position T' shown in phantom corresponding to a partially engaged lift roll. For simplicity of description, it is assumed that the strip path directly from the backup roll to the bottom applicator roll is horizontal and that the catenary form (and thus the tension T in the strip and the orientation at which the strip leaves the bottom applicator roll described by the angle $\beta$ off of horizontal) is maintained as a constant.

With the lift roll in a disengaged position, the angle of wrap $\Theta=\beta$, and the normal force $N_1$ exerted on the strip is $N_1=2T\sin(\beta/2)$ having a vertical component $N_y=T\sin\beta$ and a horizontal component of $N_x=T\cos\beta$. If the lift roll is raised to a partially engaged position characterized by a strip path from the lift roll to the bottom applicator roll having an angle $\alpha$ above horizontal, then the angle of wrap is reduced to $\beta$-$\alpha$ and the normal force $N_2$ is $N_2=2T\sin((\beta-\alpha)/2)$. The force has a vertical component $N_y=T\sin\beta-T\sin\alpha$ and an analogous horizontal component $N_x$. (The arrows drawn on FIG. 3 indicating these force components are drawn without regard to sign for convenience of illustration, and some appear to extend in the wrong direction.)

The pressure between the strip and the bottom applicator roll is not measured directly. There is also a pressure applied at the nip between the bottom applicator roll and the bottom transfer roll. This has a vertical component $P_y$ and a horizontal component $P_x$. The nip force is known and its angle is known, hence the horizontal and vertical components are known. The normal force N between the applicator roll and strip has the formula $$N^2=N_x^2+N_y^2.$$

A horizontal force measurement has the value $$P_x+N_x=X$$

and the vertical force measurement has the value $$P_y+N_y=Y.$$

Thus, there are three equations with two unknowns, $N_x$ and $N_y$ and these values are readily calculated, thereby determining the normal force between the strip and applicator roll.

The horizontal and vertical forces X and Y are measured by force measuring devices 46 such as pressure transducers or load cells coupled to the bottom applicator roll (the former operating by measuring a fluid pressure and the latter by a piezo-electric effect). The normal force is determined by working backwards through the equations above.

Based upon known properties of the coating material and the geometry of the coating machine, the measured force is converted to a thickness measurement of the coating applied to the bottom face of the strip. Thus, the force measuring device serves as an indirect means for thickness measuring. If desired, a desired force may be set as a parameter, and feedback from the force measurement used to keep the force at the desired value regardless of changes in sheet tension, oscillations, etc.

Preferably, a conventional wet thickness measuring device 47 may be positioned a few centimeters downstream from the bottom applicator roll for directly measuring the thickness of the film applied to the strip by the bottom applicator roll. A dry thickness measuring device (not illustrated) may be used for measuring film thickness after the strip has passed through the oven, however, the delay between measurement and control due to such positioning makes control to avoid very short period transient variations in thickness infeasible. If desired, such a dry thickness sensor may be used for absolute thickness measurements and control, and a sensor closer to the bottom applicator roll may be used to minimize variations from the desired thickness.

Feedback from the wet thickness sensor may also be used for continually controlling the lift roll, and hence, pressure between the applicator roll and strip, thereby controlling coating thickness. In such an embodiment, the direct pressure measurement may be used for setting a target pressure that is then maintained by feedback from the thickness sensor.

The coater system also includes one or more proximity sensors 49 adjacent to the entrance to the drying oven. The proximity sensor senses the distance between the moving strip and the sensor. Some oscillations of the strip catenary in the oven are represented by changes in elevation of the strip at the entrance to the oven. This can vary the angle of wrap of the strip around the applicator roll. Some oscillations may change the apparent tension in the strip at the applicator roll. Angle of wrap changes may be compensated by changing the lift roll position in to opposite direction for maintaining a constant wrap angle. Changes in tension can be sensed by the roll pressure sensors and the lift roll adjusted to compensate.

Outputs of the wet thickness sensor, the strip force or pressure measuring transducers and the proximity sensor are coupled to a feedback servo loop controller 48. The servo loop controller is also controlled by an input device 50 such as a keyboard or remote computer. The output of the servo loop controller is coupled to the actuator 42 for the lift roll, to the speed control for the bottom applicator roll drive motor (not shown), and to the hydraulic actuator 32 for the bottom transfer roll.

Control of the thickness of coating applied to the bottom face of the strip may be achieved by the steps of:

a. providing the servo loop controller a target thickness for the bottom coating from the input device;

b. measuring the thickness of the coating on the bottom face of the strip by means of a measuring device (e.g. the wet thickness sensor or the force transducer), and/or sensing position of the strip downstream from the bottom applicator roll; and alternatively or jointly;

c. raising and lowering the lift roll for achieving the desired target thickness; or d. adjusting the rotational speed of the bottom applicator roll for achieving the desired target thickness; or e. adjusting the nip pressure between the bottom applicator roll and the bottom transfer roll for achieving the desired target thickness; and f. repeating the sequence from step b. (or from step a. if a new target is provided).

Such a process may be carried out by a number of known feedback algorithms. For instance, according to one method, the lift roll may be raised or lowered in fixed increments regardless of the difference between a target pressure and a measured pressure between the strip and bottom applicator roll. Other methods would vary the increment by which the lift roll is raised or lowered in proportion to the difference between target and measured pressures.

Typical modes of operating such a continuous strip coating machine are as follows:

The parameters of the machine for obtaining a desired bottom coating thickness are set, such as for example, strip speed, viscosity of the coating material, temperature (coating material temperature and/or ambient temperature), bottom applicator roll rotational speed, transfer roll rotational speed, nip pressure between the applicator roll and transfer roll, and pressure between the strip and bottom applicator roll. The latter parameter is set by varying the wrap angle, which is varied by adjusting the elevation of the lift roll.

The pressure applied by the strip is kept constant by sensing pressure and adjusting the elevation of lift roll by means of the servo loop controller.

When the lift roll elevation is changed, the distance the strip travels between the backup roll and the bottom applicator roll changes. This can cause change in the relative speed of the strip and the surface speed of the bottom applicator roll (which need not be equal to each other for a desired coating effect). Such speed changes may cause undesirable streaks in the coating film.

If the lift roll is raised and the path followed by the strip is thereby lengthened, the rotational speed of the bottom applicator roll is slowed slightly as the lift roll moves upwardly to compensate for the changing path length. (The applicator roll would be accelerated slightly if the operation called for the applicator roll to rotate in the opposite direction from strip travel.) Conversely, the applicator roll would slow slightly as the lift roll moved downwardly. In this way, the relative surface speeds can be kept constant.

Typically, the rotational speed of the transfer roll(s) is coupled to the speed of the applicator roll. Thus, the transfer roll speed is adjusted commensurately.

In the event of an oscillation of the strip in the drying oven, the angle of the strip coming off the bottom applicator roll may change as indicted by the arrow T″ in FIG. 3. This changes the wrap angle of the strip, hence the pressure between the strip and the roll. This can be compensated by changing the elevation of the lift roll. This change can be detected by measuring the pressure applied by the strip or by the proximity sensor, or both.

If the angle of the strip off the bottom applicator roll changes, it represents a change in the catenary in the oven. The signal from the proximity sensor may therefore be used for anticipatory changes in lift roll elevation or changes in the rotational speed of the applicator roll to compensate for the changes in film thickness that would otherwise occur.

The signal from the wet thickness sensor can also be used for feedback for determining a new target pressure for the strip on the roll, hence a new lift roll elevation, or it may be used for varying the nip pressure or adjusting the roll speed for changing the film thickness.

There are three or more sources of information about the operating parameters (e.g. strip pressure from the pressure transducers, changes in wrap angle from the proximity sensor, and film thickness from the wet thickness sensor) and three or more machine parameters that may be varied (e.g. applicator roll speed, lift roll elevation and nip pressure). The sensor signals to the servo loop controller and control functions from the controller may include any or all of these in any desired combination for obtaining a desired coating thickness. Some of the machine parameters may be set and operated open loop and some may be controlled closed loop. For example, the lift roll elevation may be set to obtain a desired strip pressure, and control of the machine may be limited to closed loop control of applicator roll speed.

Clearly, the algorithms for controlling lift roll elevation as a function of strip pressure and/or applicator roll speed as a function of lift roll elevation are straightforward. As additional parameters are sensed and controlled, the algorithms become more complicated and virtually require control by the computer for achieving film thickness control in near real time.

In the case of machines used in combination with drying ovens, which, in addition to catenary tension, use gas flotation currents to support the strip, the thickness control of the present invention may be combined with control of the strip tension. A plurality of gas plenums 51 direct gas flotation currents, from a source such as a compressor 52, toward the faces of the strip. Suitable gas flotation means is described and illustrated in U.S. Pat. No. 4,242,807, the description of which is hereby incorporated by reference.

The pressure exerted by the gas on the strip produces a net lift force L as shown in FIG. 3. The shape of the strip in the oven, as defined by the catenary depth, may be maintained by varying the strip tension T and the lift force L. (It is noted that the presence of the force L will cause the form of the strip to deviate from a true catenary, but the term is still useful.) The relationship between L and T is not necessarily a direct inverse and will be dependent on the geometry of the individual machine. This allows control of T, which according to the previously referenced formulas affects the force between the strip and applicator roll.

The lift force L may be varied by varying the gas pressure from the source or the flow through the plenums by a variety of means known in the art. Similarly the tension T may be controlled by varying the force exerted on the strip by the coiler 36 or other receiving device such as by means of varying the torque applied by a DC motor (not shown) which drives a take-up bridle (not shown). The plenums or the gas source 52 as well as the coiler or other receiving means may be connected to the controller 48 or computer 50 to allow control of the lift and tension forces.

Accordingly, simultaneously with the steps for controlling the coating machine parameters, the tension and lift may be similarly controlled by steps such as:

a. receiving a target thickness;

b. measuring the thickness of the coating on the bottom face of the strip; and alternatively c. decreasing the tension applied by the receiving means to the strip and increasing the lift force exerted by the flotation current on the strip if the measured thickness is less than the target thickness, or d. increasing the tension applied by the receiving means to the strip and decreasing the lift force exerted by the flotation current on the strip if the measured thickness is greater than the target thickness; and e. repeating step b.

Within this feedback loop, another feedback loop may be used in combination with means for measuring the depth of the catenary to properly balance the lift against the tension so as to maintain constant catenary depth.

It may be suggested that with known geometries and physical properties, the force on the bottom applicator roll need not be measured directly, but may be computed upon measuring the height of the lift roll (by which height the strip is lifted). Although mathematically possible, measuring inaccuracies at low lift heights, and computational inaccuracies at low angles $\beta$, favor direct measurement of pressure.

The foregoing description of this invention is not an exhaustive catalog of all the ways in which the invention can be practiced in structural or procedural contexts. A variety of structures of coating machines are known. For example, some use metering rolls between the applicator and transfer rolls. Some use a structure where the top and bottom applicators are in separate machines.

In others the geometry does not yield such simple mathematical relationships, but is no less suited for application of the present invention, such as for example, where the strip path between the backup roll and bottom applicator roll is not horizontal but ascending. This configuration increases the force exerted by the strip on the bottom applicator roll and is especially desirable where a flotation oven is used so as to maintain a significant wrap angle $\Theta$ where the angle off of horizontal, $\beta$, at which the strip leaves the bottom applicator roll, approaches zero.

Although difficult to implement, it will be apparent that control could include raising and lowering the bottom applicator roll for varying the wrap angle of the strip around the roll.

Accordingly, the description is intended as illustrative and exemplary. Workers skilled in the art to which the invention pertains will recognize and readily appreciate that other arrangements are possible within the fair scope of the invention and by which the advances made possible by the invention can be achieved. Therefore, the following claims are to be read, where proper, as having application to both those things described above and shown in the drawings, and those other things which, while not expressly described, are within the fair scope of the invention according to the principles of equivalence.

What is claimed is:

1. A continuous strip coating machine comprising:

a top applicator roll for applying a coating to the top face of a strip of material;

a backup roll positioned opposite said top applicator roll for positioning the strip of material;

a bottom applicator roll for applying a coating to the bottom face of the strip of material after the strip leaves the backup roll;

a transfer roll for transferring coating material to the bottom applicator roll;

a lift roll positioned between the bottom applicator roll and the backup roll;

actuator means for raising and lowering the lift roll;

measuring means for determining the thickness of the coating on the bottom face of the strip; and feedback means coupled to the measuring means for receiving a thickness measurement from the measuring means and for controlling lift roll position in response to the thickness measurement.

2. A continuous strip coating machine as recited in claim 1 wherein the measuring means for determining coating thickness is a sensor selected from the group consisting of a pressure transducer for measuring pressure applied by the strip to the bottom applicator roll, a wet thickness sensor adjacent to the bottom applicator roll, and a proximity sensor adjacent to the strip after it leaves the bottom applicator roll.

3. A continuous strip coating machine as recited in claim 1 further comprising:

a drying oven downstream from the bottom applicator roll;

means for detecting oscillations of the strip in the drying oven; and means for changing a machine operating parameter in response to a detected oscillation.

4. A continuous strip coating machine comprising:

a top applicator roll for applying a coating to the top face of a strip of material;

a backup roll positioned opposite said top applicator roll for positioning the strip of material;

a bottom applicator roll for applying a coating to the bottom face of the strip of material after the strip leaves the backup roll;

a transfer roll for transferring coating material to the bottom applicator roll;

a lift roll positioned between the bottom applicator roll and the backup roll;

actuator means for raising and lowering the lift roll;

measuring means comprising means for measuring pressure applied by the strip against the bottom applicator roll for determining the thickness of the coating on the bottom face of the strip; and feedback means coupled to the measuring means for receiving a thickness measurement from the measuring means and coupled to the actuator means for raising or lowering the lift roll in response to the thickness measurement.

5. A continuous strip coating machine as recited in claim 4 further comprising means for changing bottom applicator roll speed is a function of change of lift roll position.

6. A continuous strip coating machine comprising:

a top applicator roll for applying a coating to the top face of a strip of material;

a backup roll positioned opposite said top applicator roll for positioning the strip of material;

a bottom applicator roll for applying a coating to the bottom face of the strip of material after the strip leaves the backup roll;

a transfer roll for transferring coating material to the bottom applicator roll;

a lift roll positioned between the bottom applicator roll and the backup roll;

actuator means for raising and lowering the lift roll;

measuring means for determining the thickness of the coating on the bottom face of the strip; and feedback means coupled to the measuring means for receiving a thickness measurement from the measuring means and for controlling, in response to the thickness measurement, a machine operating parameter selected from the group consisting of lift roll position, bottom applicator roll speed, and nip pressure between the transfer roll and the bottom applicator roll; and wherein the actuator means is controlled by the steps of:

a. receiving a target thickness;

b. measuring the thickness of the coating on the bottom face of the strip via the measuring means; and in response to the feedback means alternatively c. raising the lift roll if the measured thickness is less than the target thickness, or d. lowering the lift roll if the measured thickness is greater than the target thickness 7. A continuous strip coating machine comprising:

a top applicator roll for applying a coating to the top face of a strip of material;

a backup roll positioned opposite said top applicator roll for positioning the strip of material;

a bottom applicator roll for applying a coating to the bottom face of the strip of material after the strip leaves the backup roll;

a transfer roll for transferring coating material to the bottom applicator roll;

a lift roll positioned between the bottom applicator roll and the backup roll;

actuator means for raising and lowering the lift roll;

measuring means including a pressure transducer coupled to the bottom applicator roll for measuring force applied to the bottom applicator roll by the strip for determining the thickness of the coating on the bottom face of the strip; and feedback means coupled to the measuring means for receiving a thickness measurement from the measuring means and for controlling, in response to the thickness measurement, a machine operating parameter selected from the group consisting of lift roll position, bottom applicator roll speed, and nip pressure between the transfer roll and the bottom applicator roll.

8. A continuous strip coating machine comprising:

a backup roll for receiving a strip of material;

means for passing a strip of material to be coated around a portion of the backup roll;

a bottom applicator roll spaced apart from the backup roll for applying a coating to the bottom face of the strip after the strip leaves the backup roll;

means for passing a strip from the backup roll over the top of the bottom applicator roll and into a drying oven beyond the bottom applicator roll;

a lift roll between the backup roll and the bottom applicator roll for raising and lowering the strip;

measuring means for measuring the thickness of a coating on the bottom face of the strip; and means for moving the lift roll in response to a difference between the measured thickness of the coating on the bottom face of the strip and a desired thickness of the coating.

9. A continuous strip coating machine as recited in claim 8 wherein the measuring means includes a pressure transducer coupled to the bottom applicator roll for measuring force applied to the bottom applicator roll by the strip.

10. A continuous strip coating machine as recited in claim 8 wherein the means for moving the lift roll comprises actuator means for raising and lowering the lift roll and feedback means coupled to the measuring means for receiving a thickness measurement from the measuring means for controlling the actuator means in response to the thickness measurement.

11. A continuous strip coating machine comprising:

a backup roll for receiving a strip of material;

means for passing a strip of material to be coated around a portion of the backup roll;

a bottom applicator roll spaced apart from the backup roll for applying a coating to the bottom face of the strip after the strip leaves the backup roll;

means for passing a strip from the backup roll over the top of the bottom applicator roll and into a drying oven beyond the bottom applicator roll;

a lift roll between the backup roll and the bottom applicator roll for raising and lowering the strip;

measuring means for measuring the pressure applied by the strip against the bottom applicator roll; and feedback means coupled to the measuring means for receiving the pressure measurement from the measuring means and coupled to the lift roll for maintaining constant pressure between the strip of material and the bottom applicator roll.

12. A continuous strip coating machine as recited in claim 11 wherein the feedback means is coupled to an actuator for the lift roll for controlling the position of the lift roll.

13. A continuous strip coating machine as recited in claim 12 further comprising means for adjusting rotational speed of the bottom applicator roll as a function of changes in the lift roll position.

14. A continuous strip coating machine comprising:

a backup roll for receiving a strip of material;

means for passing a strip of material to be coated around a portion of the backup roll;

a top applicator roll opposite the backup roll and on the opposite side of the strip of material from the backup roll for applying a coating to the top face of a strip;

a bottom applicator roll spaced apart from the backup roll for applying a coating to the bottom face of the strip after the strip leaves the backup roll;

means for passing a strip from the backup roll over the top of the bottom applicator roll and into a drying oven beyond the bottom applicator roll;

lift means for elevating the strip in a portion of the space between the backup roll and the bottom applicator roll;

means for measuring the thickness of a coating on the bottom face of the strip; and control means for controlling the lift means in response to a difference between the measured thickness of the coating on the bottom face of the strip and a desired thickness of the coating.

15. A continuous strip coating machine comprising:

a backup roll for positioning a strip of material as it passes through the coating machine;

a bottom applicator roll for applying a coating to a bottom face of the strip of material after it leaves the backup roll and positioned to contact the strip over an arc defined by an angle of wrap of the strip around the bottom applicator roll;

thickness measuring means for determining the thickness of the coating applied to the bottom face of the strip;

means for changing the angle of wrap of the strip around the bottom applicator roll; and control means coupled to the thickness measuring means for receiving a thickness measurement from the measuring means and for controlling the means for changing the angle of wrap in response to the thickness measurement.

16. A continuous strip coating machine as recited in claim 15 wherein the thickness measuring means for determining coating thickness is a sensor selected from the group consisting of a pressure transducer for measuring pressure applied by the strip to the bottom applicator roll, a wet thickness sensor adjacent to the bottom applicator roll, and a proximity sensor adjacent to the strip after it leaves the bottom applicator roll.

17. A continuous strip coating machine as recited in claim 15 wherein the means for changing the angle of wrap comprises a lift roll between the backup roll and the bottom applicator roll for raising or lowering the strip.

18. A continuous strip coating machine comprising:

a top applicator roll for applying a coating to a first face of a strip of material;

a backup roll for positioning the strip of material against the top applicator roll;

a bottom applicator roll for applying a coating to a second face of the strip of material after application of a coating to the first face and positioned to contact the strip after the strip leaves the backup roll;

force measuring means for determining the force between the strip and bottom applicator roll;

means for varying the force between the strip and bottom applicator roll; and control means coupled to the force measuring means for controlling the means for varying the force between the strip and bottom applicator roll.

19. A continuous strip coating machine as recited in claim 18 wherein the means for varying the force between the strip and bottom applicator comprises means for varying the tension in the strip.

20. A continuous strip coating machine as recited in claim 18 further comprising:

a drying oven for drying the coating applied to the strip, positioned to encompass the strip after the strip leaves the bottom applicator roll;

flotation means in the drying oven comprising a plurality of plenums connected to a gas source for producing a flotation current that exerts a lift force on the strip;

receiving means for receiving and supporting the strip as it exits the drying oven, for applying a tension to the strip;

a lift roll positioned between the bottom applicator and backup rolls; and an actuator for raising and lowering the lift roll for varying the force applied by the strip against the bottom applicator roll.

21. A continuous strip coating machine as recited in claim 20 wherein the means for varying the force between the strip and bottom applicator roll comprises the flotation means and receiving means and is controlled by the steps of:

a. receiving a target thickness;

b. measuring the thickness of the coating on a bottom face of the strip; and alternatively c. decreasing the tension applied by the receiving means to the strip and increasing the lift force exerted by the flotation current on the strip if the measured thickness is less than the target thickness, or d. increasing the tension applied by the receiving means to the strip and decreasing the lift force exerted by the flotation current on the strip if the measured thickness is greater than the target thickness.

22. A continuous strip coating machine as recited in claim 18 wherein the means for varying the force between the strip and bottom applicator roll comprises:

a lift roll positioned between the bottom applicator and backup rolls;

actuator means for raising and lowering the lift roll; and feedback means for changing the lift roll elevation in response to the force measuring means.

23. A method for controlling thickness of a coating on the bottom face of a strip of material passing through a continuous strip coating machine comprising the steps of:

measuring the thickness of a coating on the bottom face of the strip by a step selected from the group consisting of:

(a) sensing the pressure applied by the strip against a roll which applies coating material to the bottom face of the strip, and (b) sensing oscillations of the strip in a drying oven; and controlling a coating machine operating parameter in response to a measured thickness of the coating on the bottom face of the strip by a step selected from the group consisting of:

(a) changing wrap angle of the strip around a roll applying coating material to the bottom face of the strip, and (b) changing nip pressure between a coating material transfer roll and a roll which applies coating material to the bottom face of the strip.

* * * * *